United States Patent [19]

Levy

[11] 4,137,692

[45] Feb. 6, 1979

[54] SYSTEM FOR METERING AND FILM PACKAGING OF BITUMEN AND LIKE MATERIALS

[76] Inventor: Giorgio Levy, Viale Coni Zugna, 43, Milan, Italy

[21] Appl. No.: 783,819

[22] Filed: Apr. 1, 1977

Related U.S. Application Data

[63] Continuation-in-part of Ser. No. 419,818, Feb. 12, 1974, abandoned.

[51] Int. Cl.[2] ..... B65B 63/08; B65B 53/06

[52] U.S. Cl. ..... 53/440; 53/442; 53/477

[58] Field of Search ..... 53/25, 26, 28, 32, 122, 53/127, 235, 249, 30 S, 33; 425/261, 447; 105/145

[56] References Cited

U.S. PATENT DOCUMENTS

| | | | |
|---|---|---|---|
| 2,127,402 | 8/1938 | Gillican | 53/25 X |
| 2,136,876 | 11/1938 | Chaveas et al. | 53/25 |
| 2,423,915 | 7/1947 | Wacker | 53/25 |
| 2,664,592 | 1/1954 | Ingraham et al. | 425/447 |
| 3,375,636 | 4/1968 | Redmond | 53/122 |
| 3,564,808 | 2/1971 | Kent | 53/25 |
| 3,641,732 | 2/1972 | Fujio | 53/30 S X |
| 3,696,580 | 10/1972 | Saltzer, Sr. | 53/30 S X |
| 3,763,661 | 10/1973 | Betschart et al. | 425/261 X |
| 3,832,825 | 9/1974 | Dunbar | 53/25 |
| 3,837,778 | 9/1974 | Parker | 53/122 X |
| 3,895,476 | 7/1975 | Burns | 53/30 S X |

*Primary Examiner*—Horace M. Culver
*Attorney, Agent, or Firm*—Kirschstein, Kirschstein, Ottinger & Corbin

[57] ABSTRACT

A system for metering and film packaging of bitumen and like materials that are solid at room temperature and molten liquid when heated. The packaging film is thermoplastic, having a melting point not exceeding the temperature of molten bitumen. The material of the packaging film in liquid form is compatible with bitumen without deleteriously affecting the characteristics of the bitumen. In the system, bitumen in a hot molten state is pumped at a filling station into empty molds that are lined with release material. The fluid bitumen is metered at the filling station to supply a predetermined quantity in each mold. The filled molds are conveyed through a lengthy cooling station that may include a water bath and after a suitable time, e.g. 2 to 4 hours, the bitumen solidifies into slabs. The indivudual molds are comprised of multiple sections including a removable bottom and side walls that can shift from a closed mold-defining position to a discharge position in which the side walls are spaced apart sufficiently to permit the solidified slab to leave downwardly through an open bottom. The system includes an ejection station at which the molds are successively opened and the bottoms momentarily removed to permit pushers to force the slabs downwardly out of the molds onto a conveyor that leads the slabs to a wrapping station at which the cooled solidified slabs are packaged in a biaxially oriented stretched heat-shrinkable thermoplastic film. Thereafter the enveloped slabs are transported through a shrink tunnel to contract the wrapped film tautly about the slab. Next the shrink-wrapped slabs are stacked on pallets ready for shipment. The molds from which the slabs were discharged are closed, the bottoms reapplied and the molds are recycled.

8 Claims, 11 Drawing Figures

SYSTEM FOR METERING AND FILM PACKAGING OF BITUMEN AND LIKE MATERIALS

RELATED APPLICATION

This application is a continuation-in-part of copending application Ser. No. 419,818, filed Feb. 12, 1974, now abandoned, by the same applicant for a system of Metering and Packaging Bitumen and Alike Materials which are Fluid at the Time of Production.

BACKGROUND OF THE INVENTION

1. Field of the Invention

A method and apparatus for molding and packaging bitumen and similar materials.

2. Prior Art

It now is customary to furnish packaged industrial bitumen in paper bags which are ripped off before the bitumen is melted. The paper must be waterproofed for outside storage. Such bags are relatively expensive and are susceptible to tearing. The bitumen usually is poured molten into the bags so that there is a tendency for it to stick and for paper scrap to become mixed into the bitumen when it subsequently is employed, as for roofing and road surfacing. The presence of paper can clog machines used to apply molten bitumen. It also has been proposed to line paper bags with a metal foil or a film of non-melting plastic. Such lined bags are inconvenient and expensive to use. Furthermore, it has been suggested to feed molten bitumen into a flexible plastic bag in which it was hardened. The bags had to have softening point of at least about 50° C above the temperature of molten bitumen and the bags had to be supported and cooled during and after their filling in order to maintain their integrity; moreover the bitumen entered and hardened in the seams and crevices of bags, making their removal difficult.

The equipment previously used included bag filling machines wherein the bags constituted molds for the liquid bitumen. Although this seemed to be quite economical, entailing as it did forming the bitumen in place in its desired configuration and then allowing it to solidify in its packaging container, this arrangement was subject to the aforementioned defects of: difficulty in the choice of bagging materials, difficulty in keeping thermoplastic bags cool enough during and after pouring to prevent the bags from being destroyed, and difficulty in stripping bags from solidified bitumen.

SUMMARY OF THE INVENTION

Purposes of the Invention

It is an object of the present invention to provide a process and equipment which overcome the drawbacks of previous systems and is able to furnish packaged slabs of bitumen that can be stored and handled with ease and used with a minimum of effort and time involved in making the bitumen available for melting.

It is another object of the invention to provide equipment of the character described which is relatively economical to make, install and use, and is capable of high volume production.

It is another object of the invention to provide a system for molding and packaging bitumen and the like wherein the bitumen is formed in a base mold from which it is removed and only thereafter packaged whereby to permit the use of appropriate packaging materials and appropriate packaging methods without being restricted by the inherent problems that accompany the molding of hot liquid bitumen directly in its final package.

It is another object of the invention to provide a system of the character described that permits the use of a package which can be removed easily from a slab that has been formed before it was packaged.

It is another object of the invention to provide a system of the character described that permits the use of packaging film that can be peeled readily off a preformed bitumen slab which was applied to the slab after its solidification.

It is another object of the invention to provide a system of the character described which permits the use of a thermoplastic packaging film that has a softening and melting point too low to be used as a container into which hot molten bitumen could be poured at least without adjuncts to prevent destruction of the container.

It is another object of the invention to provide a system of the character described which permits the use of a thermoplastic packaging film that has a melting point lower than the temperature of molten bitumen and which is compatible with and dispersible in molten bitumen so that the film does not have to be removed from bitumen slabs when the latter are placed in a melting vat.

It is another object of the invention to provide a system of the character described which permits the use of a durable, tough, strong, weather-resistant packaging film that will protect bitumen slabs during storage and handling and will allow bitumen slabs to be stacked to a substantial height, e.g. 4 meters, thereby to enlarge the available capacity of existing storage areas.

It is another object of the invention to provide a system of the character described which permits the use of a biaxially oriented stretched thermoplastic heat-shrinkable packaging film to form shrunk envelopes for premolded bitumen slabs whereby the envelopes are tight on and faithfully follow the contours of such slabs and with them constitute neat and attractive packages that occupy a minimum of space.

It is another object of the invention to provide a system of the character described that includes a slab forming station at which molds are filled with hot molten bitumen, a cooling station at which the bitumen hardens into solid slabs, an ejection station at which the slabs are removed from the molds, a packaging station at which the slabs are enveloped in heat-shrinkable packaging film and a shrinking station at which the envelopes are subjected to heat so as to contract them around the slabs.

It is another object of the invention to provide a system of the character described in which operations are performed at the slab-forming stations in a closed cycle wherein molds are circulated from the filling station to the cooling station and the ejection station and then back to the filling stations in an automatic fashion, the ejected slabs then being automatically enveloped and the envelopes shrunk, thus enabling the system to be run under the control of a single operator, and a laborer to supply unpackaged bitumen to melting vats and to remove the packaged bitumen slabs.

It is another object of the invention to provide a system of the character described wherein the molds into which molten bitumen is introduced are structured to allow relative opening movement of the side walls thereof in a horizontal direction and removal of their bottoms in order to enable gravity assisted ejection of solidified slabs therefrom and in which the inner surfaces of said walls and bottom are coated with release material to minimize adhesion of the bitumen slab to the mold, the release material retaining its ability to maintain the mold walls non-adhesive over long periods of operation.

Other objects of the invention in part will be obvious and in part will be apparent from the detailed description of the invention set forth hereinafter.

BRIEF DESCRIPTION OF THE INVENTION

A plant for carrying out the present invention includes a large number of molds which preferably are arranged in groups, e.g. pairs or double pairs, the groups being transported by a conveyor such as a chain that moves the molds through a closed path which includes the following stations: a mold-filling station at which hot molten bitumen is charged in metered amounts into the empty molds, a cooling station at which the temperature of the liquid bitumen is gradually reduced, as by exposure of the molds to the atmosphere and/or to water in a bath, until the bitumen solidifies into slabs in the molds and an ejection station at which the side walls of the molds are moved apart and the bottoms of the molds removed, and at which pushers downwardly engage the slabs to ensure freeing of the slabs from the molds, the molds thereafter being reclosed at the ejection station and carried back to the filling station by the conveyor for repeated use in the foregoing manner.

After discharge from the molds at the ejection station, the slabs are led to a wrapping station wherein the cooled solidified slabs are enveloped in a packaging film of a biaxially oriented stretched flexible thermoplastic heat-shrinkable material such as polyethylene having a melting point lower than the temperature of the bitumen when molten. The film does not adhere to the cooled slab, but in liquid form it is compatible with and will readily disperse throughout a molten mass of the bitumen. The film, furthermore, is heat-sealable. At the wrapping station the film is formed into loosely fitting envelopes about slabs. Next the loosely wrapped slabs are transported to a shrinking station, such as a heated tunnel where the envelopes are raised to a temperature sufficiently high to enable the film to contract and, hence, the envelopes will shrink about the slabs, conforming closely to the outlines thereof in order to provide an elastic, weather-resistant, tough cover for each slab. Lastly the wrapped slabs are palletized in multi-slab-high stacks for ready handling, as with fork lift trucks for compact storage.

BRIEF DESCRIPTION OF THE DRAWINGS

Referring now in detail to the drawings, in which is shown one of the various possible embodiments of the invention.

DETAILED DESCRIPTION OF THE PREFERRED EMBODIMENT OF THE INVENTION

Figure 1:
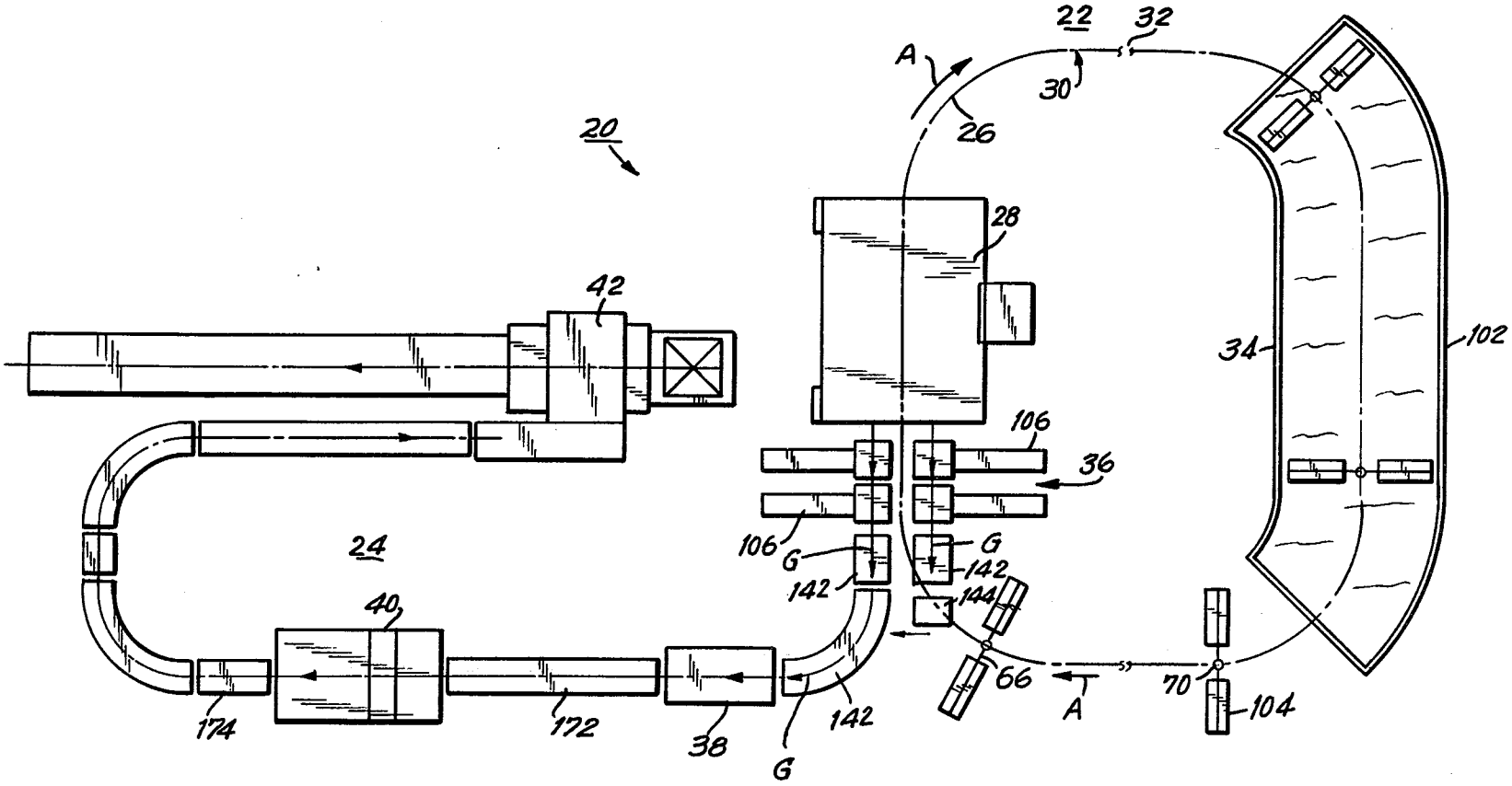
FIG. 1 is a schematic layout of a plant incorporating the present invention.

A plant 20 embodying the sundry equipments of the instant invention and designed for the practice thereof is shown in FIG. 1. It consists basically of two sections, namely, a slab forming section 22 and a formed slab handling section 24. In the slab forming section 22, molds are moved in a closed path 26 from a filling station 28 to a cooling station 30, which includes an air cooling segment 32 and a water bath 34, to a slab ejection station 36 and then back to the filling station. In the slab handling section 24, slabs are moved from the slab ejection station 36 to a wrapping station 38, thence to a shrinking station 40 and finally to a palletizing station 42 from which stacked slabs are removed for storage or shipment. The details of the equipment at the sundry stations are, in general, not crucial to the practice of the invention; nevertheless, these details will be set forth to a considerable extent both to facilitate understanding of the invention and to outline certain features at various stations that are of substantial assistance in effectuating the preferred form of said invention.

Figure 7:
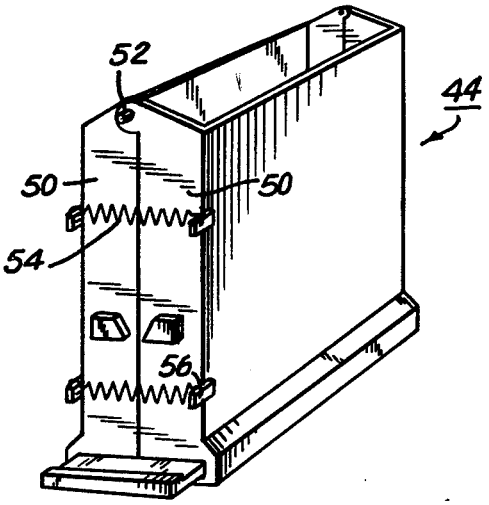
FIGS. 7 and 8 are perspective views of a mold in open and closed positions, respectively.
Figure 8:
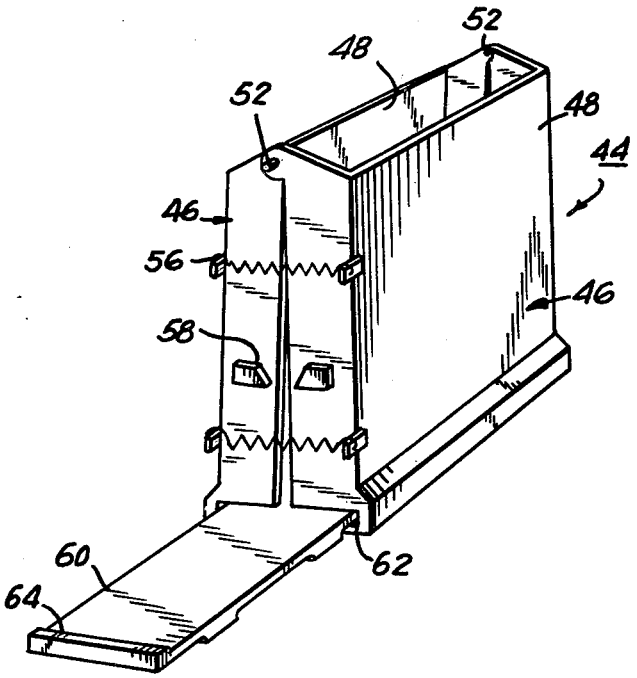

The slab forming section 22 utilizes a large number of molds 44 the structure of which is best shown in FIGS. 7 and 8. Essentially each mold is composed of side walls and a bottom and which are so interrelated that the side walls can move relatively to one another from a closed position (FIG. 7) to an open position (FIG. 8). In closed position the side walls define a mold cavity which is open at the top and bottom and which is of uniform horizontal cross-section, i.e., has a configuration that is uniform from top to bottom, the sides of the cavity being flat and vertical. A desirable shape for the cavity is that of a rectangular parallelepiped. In open position the side walls, or at least two opposed side walls, have moved away from one another so as to enlarge at least one horizontal dimension of this cavity. The bottom is moveable from a closed position (FIG. 7) in which it blocks the lower end of the cavity to an open position (FIG. 8) in which the lower end of the cavity is unblocked.

In order to achieve the just described arrangement, each mold 44 is composed of two halves 46. Each half includes a broad complete side wall 48 and two narrow half side walls 50. The walls 48, 50 are vertical, the walls 50 being in one-piece with the wall 48, perpendicular thereto and at the opposite edges thereof. The two halves 46 are mirror images of one another and are so oriented that the walls 48 of the two halves are mutually spaced apart and the walls 50 are mutually aligned and extend toward one another. The halves thus are trough-shaped with the hollow interiors facing one another. The halves are rotatably joined, as by pins 52 at the upper inner corners of the walls 50 to provide a horizontal axis about which the halves can swing from a closed position (FIG. 7) to an open position (FIG. 8).

Suitable seals, not shown, and composed, for example, of tongue and groove joints, may be provided which interfit sufficiently closely to inhibit leakage of molten liquid bitumen.

Means is provided to bias the halves to closed position (FIG. 7), said means, as shown constituting upper and lower tension coil springs 54 at each narrow end of the mold stretched between lugs 56. The springs are strong enough to hold the mold halves in closed position during and after filling of the molds with liquid bitumen.

To assist in opening of the mold at the ejection station, each narrow half side wall has affixed thereto a stud 58, the studs on the matched walls 50 being horizontally registered and their facing sides being spread apart to permit entry of a machine element therebetween. These facing sides are flat and converge downwardly toward one another to provide a downwardly tapering space the purpose of which later will be pointed out.

To removably receive a bottom wall 60, the lower edge of each broad side wall 48 is formed with an inwardly facing groove 62. The grooves in the opposite side walls 46 are in horizontal registry and face one another, the spacing between the grooves in closed position of the molds being such as to snugly receive the bottom wall 60 which can be slid into or out of the grooves in an endwise direction relative to the mold. One end of the bottom wall has a ridge 64 designed to be engaged by a gripper that will either insert or extract the bottom wall.

Figure 3:
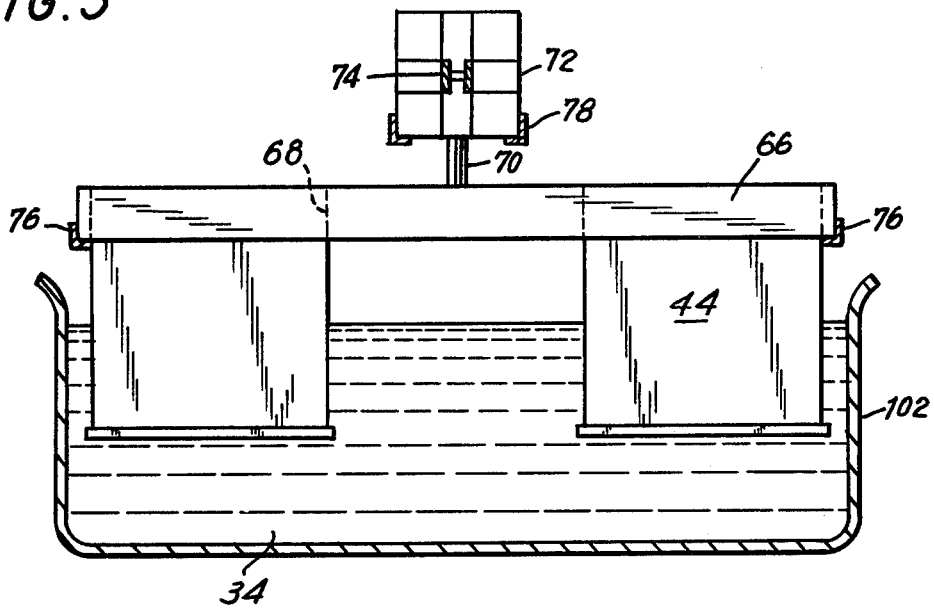
FIG. 3 is a transverse elevational sectional view through the water bath at the cooling station.
Figure 4:
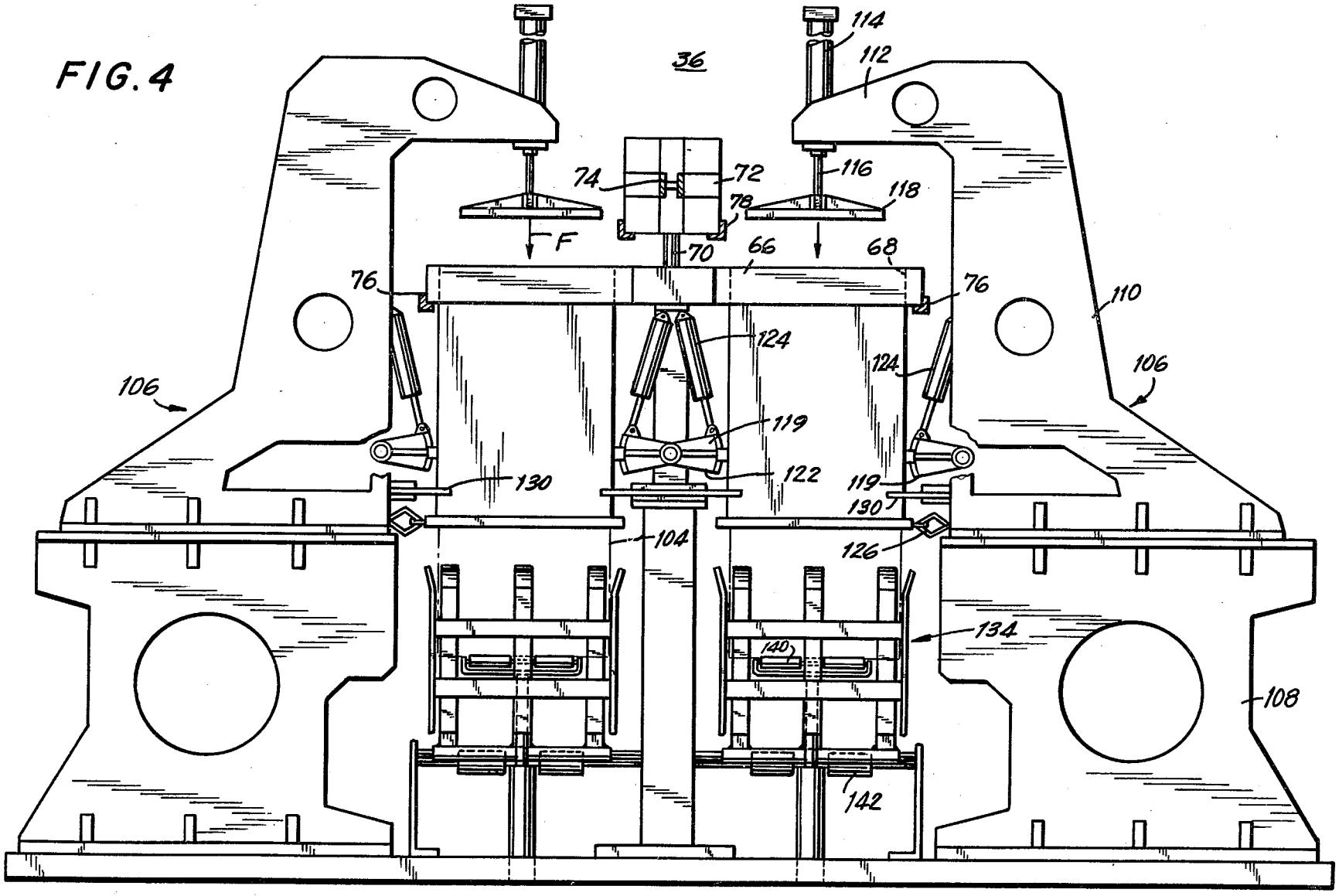
FIG. 4 is a front elevational view of the ejecting station.
Figure 5:
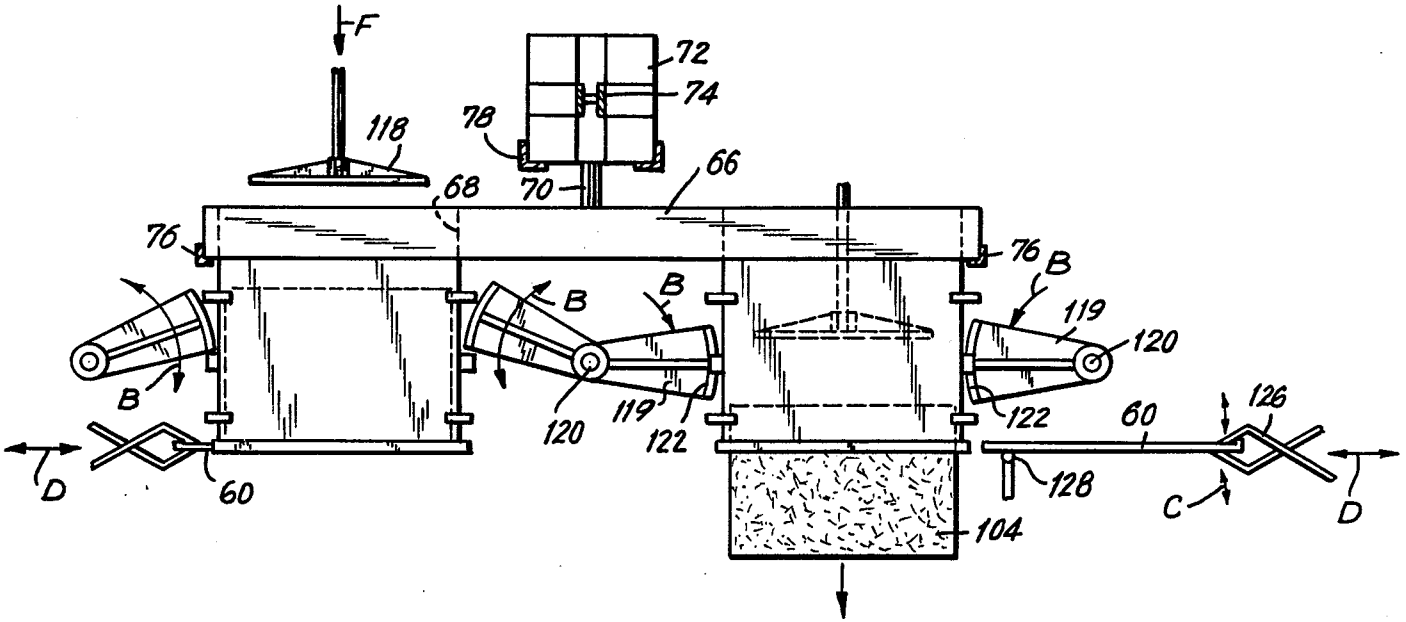
FIG. 5 is a front elevational view of a detail of the slab removal equipment at the ejection station.

To maximize the output of the plant, the molds 44 are provided in groups, e.g. groups of two or more, even numbers of molds in each group being preferred. As shown, in the plant 20 each group has two molds (FIGS. 3, 4, and 5) which are supported adjacent opposite ends of a cross-bar 66. The corss-bars have vertical openings 68 therein in which the upper ends of the molds are situated, the molds being connected to the cross-bars by the pins 52. The openings are large enough to enable the halves of the molds to swing apart when forced to do so at the ejection station. The openings enable the molds to be filled through their open mouths and finished slabs to be forced out of their bottoms when the molds are in open position with their bottoms temporarily off.

Each cross-bar hangs by a link 70 from a carrier 72. There are a large number of carriers, one for each cross-bar, connected in mutually spaced relationship to a transport chain 74 which is guided in the closed path 26 (shown in a dot-and-dash line in FIG. 1) from the filling station 28 to the cooling station 30 to the slab ejection station 36 and back to the filling station. The molds are disposed athwart the chain, one to each side. As they move around the path 26, the ends of the cross-bars ride on a set of rails 76 that hold them horizontal and stabilize them as they travel and as operations are performed on the molds carried thereby. Another set of rails 78 guide the supports and hence the chain 74 around the path 26. A powered sprocket (not shown) actuates the chain intermittently in such a timed manner that each cross-bar with its associated molds stops at the filling station and the ejection station for a brief period long enough for the equipment at such stations to perform the necessary operation on the molds. A suitable speed for the chain is 1.2 meters per second while it is moving. Such start-and-stop motion of the molds has no effect on the cooling of the slabs as they are transported through the cooling station.

Figure 2:
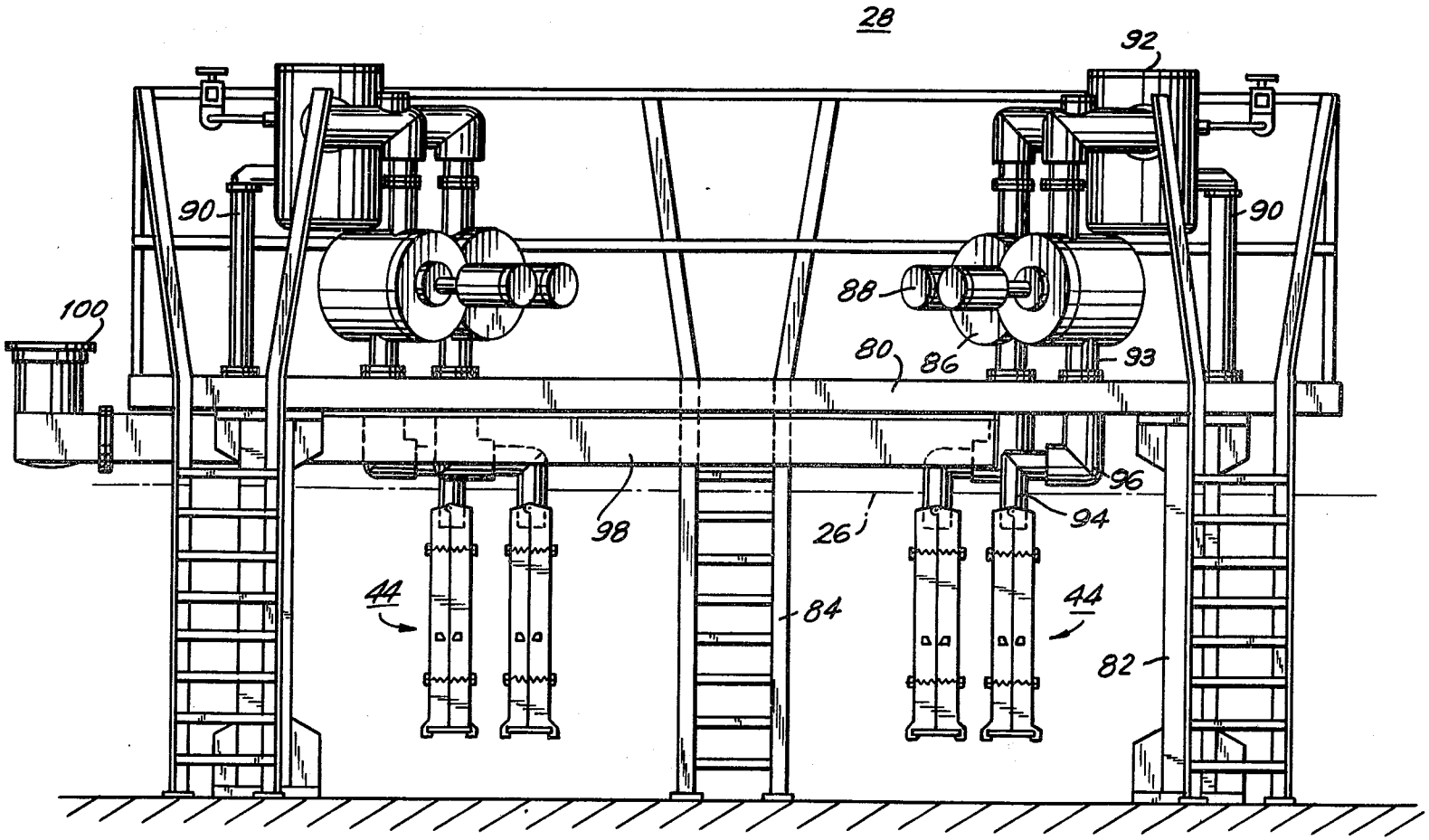
FIG. 2 is a front elevational view of the filling station.

Details of the filling station 28 are shown in FIG. 2. This station includes an elevated platform 80 composed of a grated flooring beneath which the chain 74 passes. The carriers 72 and cross-bars 66 have been omitted from FIG. 2 to simplify the figure; the molds 44 are, however, illustrated, but their associated cross-bars have been tilted in a horizontal plane so that the molds in each pair are shown as displaced, i.e., one mold of each pair leading the other at said stations although they actually lie in a plane perpendicular to the chain. This has been done in the drawings so that both molds of each pair and the filling equipment for each mold can be seen since their perpendicular arrangement otherwise would have caused one mold and its filling equipment to block the other and its equipment. The platform 80 is held in elevated position by columns 82, access to the platform being gained by ladders 84. Situated on the platform are four metering pumps 86 each having its own drive motor 88. The motors are actuated intermittently and only when the chain 74 is stationary at which time at least one pair of molds is beneath the platform in a suitable position to be filled. To speed up the filling operation, four pumps and motors are used, as just mentioned, thus effecting the filling of two pairs of mold simultaneously every time the chain halts. The molds thus filled are one pair of an odd-numbered set and one pair of an even-numbered set, assuming that the pairs of molds are numbered in sequence. Molten liquid bitumen which is heated in a tank at a location remote from the filling station is forced at a pressure of about 15 p.s.i.g. through conduits 90 and an accumulator tank 92 to the several metering pumps 86 which upon each actuation of their motors 86 will force molten bitumen in a metered amount out of discharge outlets 93. The motors and their pumps will discharge a predetermined volume of bitumen when actuated, this being selected to be enough to fill a mold to a predetermined level selected by the owner of the plant. Typical amounts of bitumen are 25 kg, 35 kg and 50 kg per mold. A typical temperature for the molten bitumen is from about 170° C to about 180° C. Each discharge outlet terminates at a discharge spout 94. The tips of the spouts include non-drip nozzles (not shown) including valves that open when the metering pumps are actuated and closed immediately when the pumps stop. The spouts are mounted in fittings 96 in which they can oscillate about horizontal axes from idle positions in which the tips of the spouts are at a level about the openings 68 in the cross-bars so as to allow the cross-bars to move beneath the filling station, to filling positions in which the tips of the spouts are within the mouths of molds to be filled. In filling position the spouts are directed at downward angles into the molds. The empty molds are in their closed positions as they approach and enter the filling station after leaving the ejection station. A typical time to fill a mold of 35 kg weight is about 20 seconds for which the dwell time of the mold at the filling station is about 30 seconds. Gases liberated during the filling of the molds are substantially removed by suction inlets 100 in a manifold 98 connected to a suction line.

The cooling station 30 may simply consist of a long air cooling segment 32 through which the molds travel in the direction of the arrow A (FIG. 1) after leaving the filling station or it may additionally include a water bath 34 (FIG. 3) which is a long tank 102 into which the molds are lowered. The most economical layout will depend on water availability and cost; an excellent arrangement is to employ a rather long air cooling segment in which the molten bitumen loses most of its heat and becomes almost solid and a short water bath in which the bitumen hardens and cools to form slabs 104. A typical total length of closed path which predominantly constitutes the cooling segment is in the order of 235 meters, the cooling time being about three and one half hours for a 35 kg slabs. Such a line has about 850 pairs of molds or about 1700 molds altogether.

From this cooling station the closed molds with solidified slabs of bitumen are transported to the slab ejection station 36 (FIGS. 4, 5, 6 and 9). This station, for the benefit of increased throughput, has four ejection mechanisms 106 arranged in pairs (see FIGS. 1 and 4) with one mechanism of each pair being on one side of the path 26 and the other on the other side. One pair of mechanisms operates an even numbered pair of molds when such molds are stationary thereat and the other pair of mechanisms similarly operates on an odd numbered pair of molds.

Each mechanism 106 includes a base 108 from which a column 110 extends upwardly to terminate in a cantilevered head 112 that is located above the path of travel of molds at one end of the cross-bars. A vertical hydraulic linear motor 114 on the head is positioned to be centered above a mold temporarily stationary at the ejection station. The lower end of the piston 116 of the motor is attached to a horizontal ram 118. The ram is shaped (FIG. 6) to easily fit into the open top mouth of a closed mold. The motor 114 is retracted (idle) condition maintains the ram above (FIG. 4) the path of travel of the cross-bars and in extended (actuated) condition forces the ram well into the mold enough to press strongly against a slab, the mold now being open and the bottom wall 60 being off, so as to eject the slab. Four slabs are ejected from four molds at each cycle of the station 36.

Suitable means is included at the ejection station to open the pairs of molds located beneath the rams before the rams commence their descent. Said means comprises, for each mechanism 106, two shoes 119, each at a different side of a stationary mold at the ejecting station. The shoes are mounted on horizontal pivots 120 to swing from an upper position (see left side of FIG. 5) to a lower position (see right side of FIG. 5). In their upper position the lower ends of the arcuate edges 122 of the shoes are centered above the downwardly tapering spaces between the inner edges of the studs 58 of closed molds halted at the ejection station. The shoes are shifted between their upper and lower positions in the directions indicated by the arrows B by linear hydraulic motors 124 that are pivotally connected to the frame at their upper ends and to the shoes at their lower ends. As the shoes swing to their lower positions they enter the spaces between the studs to swing the mold halves 46 apart on the pins 52, assuming the bottom wall first is removed.

Means is provided to shift the bottom wall horizontally between mold bottom closed and mold bottom opened positions. Said means comprises gripper jaws 126 having means (not shown) to shift the same in directions indicted by the arrows C between closed positions (FIGS. 4 and 5) and open positions (not shown). The jaws also have means (not shown) to reciprocate them in the direction of the arrow D between inner positions (left hand side of FIG. 5) and outer positions (right hand side of FIG. 5). In the inner open position of the jaws one jaw is above and the other below the projecting end of a bottom wall static at the ejection station, the tips of the jaws being slightly inwardly of the ridge 64. When a mold comes to rest at the ejection station the jaws are closed to engage the bottom wall of the mold and then are moved outwardly to slide the bottom wall laterally away from the mold and thus open the mold bottom. The inner end of the bottom plate is supported on a roller 128 in its outermost position. It is after the bottom wall has been pulled away that the ram 118 descends to push the slab 104 out of the mold.

Separation of the slab from the mold both during mold opening and ram descent is facilitated by release coatings on the inner surfaces of the mold halves and the upper surface of the bottom wall. Appropriate materials for the release coating are: R.T.V. silicone rubber, Teflon, Quilon and silicone.

After the slabs leave the molds the bottom walls are reinserted in the grooves 62 by retrograde inward movement of the jaws 126 whereupon the jaws open and the molds are closed by the springs 54. Thereafter the closed empty molds are advanced by the chain 74 to the filling station.

It is desirable to steady the hanging molds during withdrawal of the bottom walls. The means provided for this purpose is clamps 130 one at each side of each mold when it is stationary at the ejection station. Each clamp is shiftable horizontally from an outer position (right side of FIG. 6) to an inner position (left side of FIG. 6) in a direction indicated by the arrows E. The clamps include pivotally connected pairs of clasping arms which are oscillatible toward and away from one another between an open position (right side of FIG. 6) and a mold engaging position (left side of FIG. 6).

Figure 6:
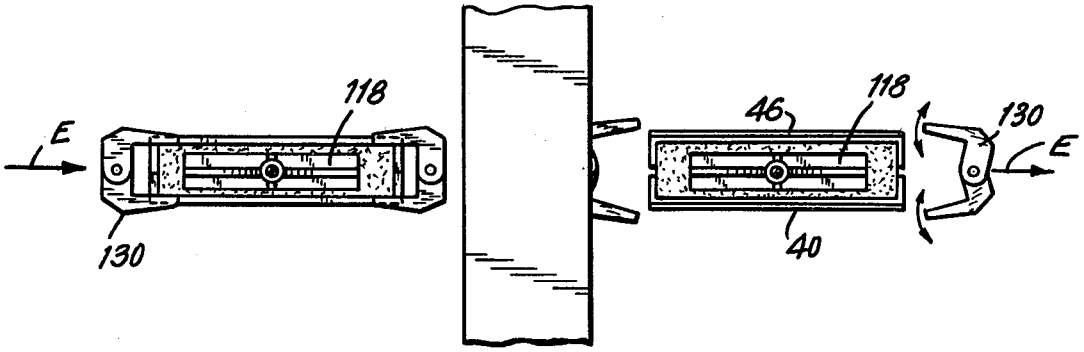
FIG. 6 is a top plan view of the equipment shown in FIG. 5.

When a cross-bar arrives at an ejection mechanism 106 and molds come to a halt beneath the rams 118, the clamps 130 are in their outer positions with their clasping arms open as shown at the right side of FIG. 6. Then the clamps move to their inner positions while still open and next the clamps close to squeeze the mold at its leading and trailing surfaces (left side of FIG. 6). Thereupon the gripper jaws in open position move in beyond the ridge 64 and close to engage the bottom wall after which the closed jaws are moved outwardly to pull the bottom wall from the mold while the gripper jaws stay closed. This leaves the mold bottomless. The inner end of the bottom wall rests on the roller 128. All this time the two halves of the mold stay closed. Now the clamps 130 open and are shifted outwardly, and as they open, but while the molds are essentially stable, the shoes 119 swing downwardly and the lower ends of their edges 122 enter between and engage the studs 58. The opening and outward movement of the clamps 130 is thereupon completed enabling further downward movement of the shoes to spread the mold halves about the pins 52. Only a small divergence of the mold halves (FIGS. 6 and 8) is needed to open the molds enough to permit ejection of the slabs. Depending on the state of the release coatings, opening of the molds may be sufficient to release the slabs and allow them to drop. Nevertheless, during or after opening of the molds the rams descend to positively eject any slabs that still may be sticking to a mold. The downward direction of movement of the rams is indicated by the arrows F. When the slabs are released, the molds, still stationary at the ejection station, close themselves by action of the springs 54 upon raising of the shoes and are positively closed by the clamps and while so held closed the gripper jaws shift the withdrawn bottom walls inwardly to close the lower ends of the molds. The chain 74 is started up at the end of the ejection cycle to commence movement of the molds back toward the filling station, thus completing one full cycle of operations in the slab forming section.

Figure 9:
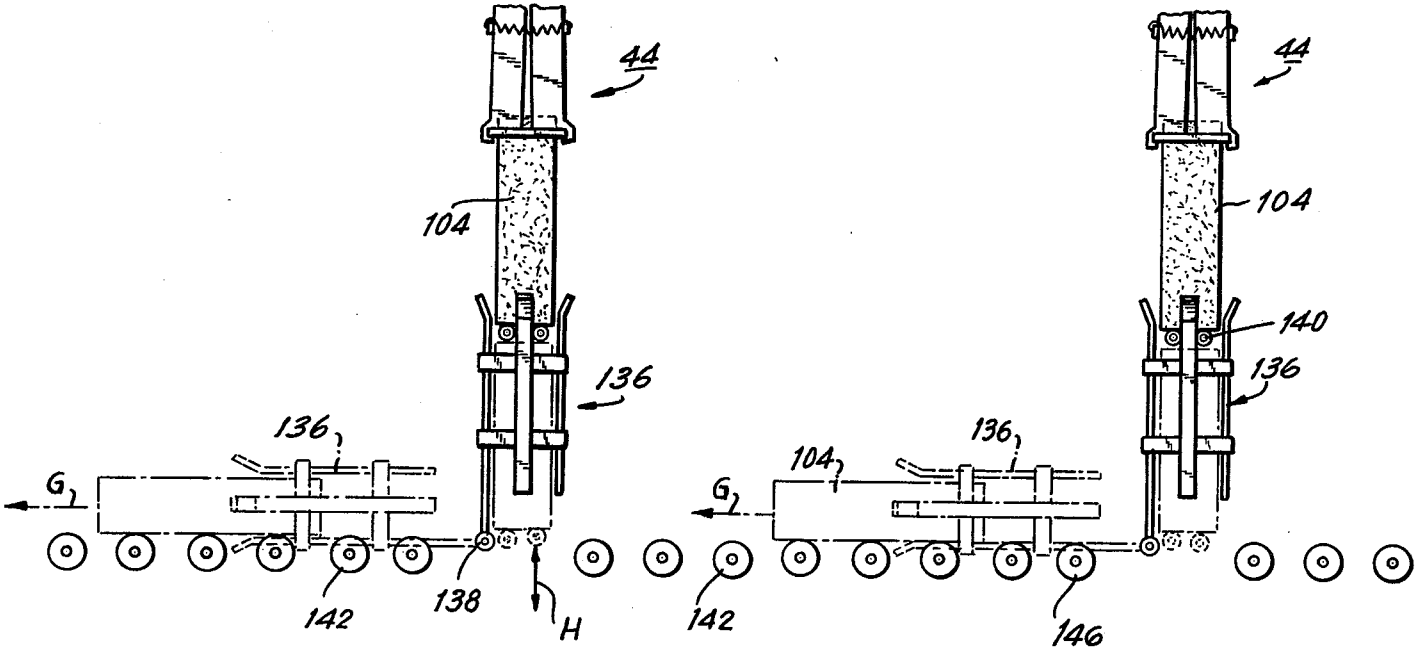
FIG. 9 is a side elevational view of a detail of the slab removal equipment at the ejection station.

Referring now to the slab handling section 26, the first element thereof is a slab turning means 134 located at the ejection station 36, but not constituting a part of the slab forming sections. The slab 104 as it is discharged from a mold (FIGS. 5 and 9) is vertical, i.e., its broad faces are in vertical planes so that it would be difficult to transport to handling stations unsupported. It is for this reason that the turning means is provided to change the orientation of the slab to a horizontal one. The turning means 134 (FIGS. 4 and 9) is directly under the rams and, more specifically, directly under molds that are stationary at the ejection station. Each turning means, there being two, one for each ram, includes a basket 136 with an open top and an open bottom. A basket 136 is defined by a plurality of vertical slots, three to each broad face and two to each narrow face, and two horizontal circumferential slats. Thus the basket is skeletonized whereby access to a slab in the basket is available. The upper ends of all the vertical slats are flared outwardly (FIGS. 4 and 9) to form a funnel shaped open top that ensures easy entry of a downwardly falling slab (see the dot-and-dash line positions of the slabs in FIG. 9). The slats of the leading broad face and the sides of each basket have their lower ends below the lower ends of the slats at the trailing broad face. Each basket is mounted on a shaft 138 for rotation about a horizontal axis between an erect position (solid lines in FIG. 9) and a horizontal position (dot-and-dash lines in FIG. 9) in which its open flared mouth points away from the turning station in the direction of the arrow G (FIGS. 1 and 9). The shaft 138 is located on the broad face of the basket at the bottom leading edge thereof. A set of lowering rollers 140 define an elevator located to operate within the basket 136 when the same is in vertical position. The rollers are raised and lowered by suitable means (not shown) between an upper position (solid lines in FIG. 9) in which they are within the vertical basket at a high level near the flared mouth thereof and a lower position (dot-and-dash lines in FIG. 9) in which they are at the bottom end of the vertical basket. The bottom end of the basket is directly over and at the level of a roller conveyor 142, the rollers of which are driven to move an object supported thereon in the direction G.

When a slab drops from an opened mold into the basket the lowering rollers are in their upper position and immediately, before the slab has had a chance to topple, commence moving downwardly to deliver the slab with it to a lower position at slightly above the elevation of the roller conveyor. Then the basket is swung from vertical to horizontal position. In such horizontal position the rollers of the conveyor which underlie the now horizontal slab extend through the skeletonized basket to engage the undersurface of the slab. Said rollers at the turning station are split, i.e., short (FIG. 4) to permit them to protrude through openings in the then underside of the basket. The roller conveyor immediately transports the slab out of the basket to the wrapping station 38.

Since the ejection mechanism 106 here shown are provided in trnsversely registered pairs, the plant 20 includes two side by side roller conveyors 142 (FIGS. 1 and 4) and it is desirable to combine the two lines of horizontal slabs into a single line. This is effected by a transfer mechanism 144 (FIG. 1) which, as a slab reaches it, shifts the same from one roller conveyor to the other whereby the slabs now proceed in single file to the wrapping station.

The baskets are returned to their erect position after they are left by the slabs.

Figure 10:
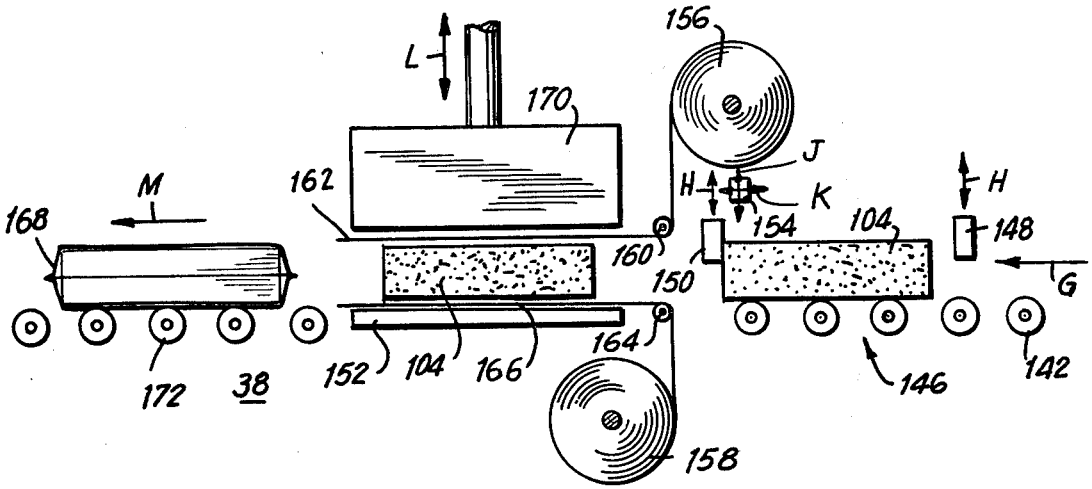
FIG. 10 is a side elevational view of the slab wrapping station.

As the wrapping station (FIG. 10), a stutter delivery means 146 interrupts the continuous movement of slabs on their way to the wrapping station and delivers the slabs to the station 38 one at a time. Said stutter means includes a rear blocking bar 148 and a front blocking bar 150 each of which is vertically reciprocable in the direction indicated by the arrows H. The rear bar in its down position prevents a slab from entering a prewrapping position behind the front bar. With the front bar raised, a slab in the prewrapping position is driven onto a wrapping platen 152 while the following slab is held back by the rear bar. As the leading slab is moved onto the platform it passes under a positioning bar 154 which is movable vertically in a direction indicated by the arrow J and also movable horizontally in a direction indicated by the arrow K, this being parallel to and coincident with the direction G immediately ahead of the wrapping station (FIG. 10). As the slab passes under the positioning bar 154, said bar is in its right hand position (FIG. 10) immediately behind the front bar 150. When the slab has been transported onto the platen 152 as far as it can by the conveyor 142 and its trailing edge is in front of the bar 154, the bar 154 lowers in the direction J to the level of the slab and moves forwardly in the direction K to place the slab fully on the platen 152 (FIG. 10). Next the front bar is moved down and the rear bar is moved up to transport the following slab to prewrapping position after which the rear bar descends to hold the then following slab stationary. The positioning bar is moved back to its elevated position in back of the front bar.

The wrapping station has an upper roll 156 of film and a lower roll 158 of the same film. Both rolls are mounted to turn about horizontal axes. The film is thermoplastic and tough. It has a melting point, e.g. 160° C, not in excess of the temperature of the molten bitumen so that if the bitumen is heated to a temperature at which it is liquid the material of the film will melt. Moreover the material of the film is such that it is compatible with the bitumen and will, when liquid, disperse freely and uniformly throughout molten bitumen. When the material of the film is mixed with molten bitumen, keeping in mind the relatively small amount of film material present as an envelope for a bitumen slab, the incorporation of said film material has no noticeably adverse effect on the physical characteristics of the bitumen. Thickness of film between about 80 microns and 200 microns have been found to be useful. Polyethylene is the material of choice for the film. Preferably the film, prior to wrapping, is biaxially oriented, stretched and heat-shrinkable.

Film is led from the upper roll 156 under a guide roller 160 to provide a reach 162 overlying the slab 104 fully on the platen 152. In FIG. 10 the reach 162 has been shown spaced slightly above the slab 104 for clarity of illustration, actually it will rest on the slab. The film is advanced to the illustrated position by grippers (not shown) such as are employed conventionally for pulling film. Film is led from the lower roll 158 over a guide roller 164 to provide a reach 166 overlying the platen 152 under a slab 104 that is fully thereon. The reach 166 has been shown in FIG. 10 as spaced slightly above the platen 152 and slightly below the slab 104 for clarity of illustration; actually the reach 166 is in contact with the platen and the slab 104 rests upon the reach 166. The film from the roll 158 likewise is advanced to the position illustrated at FIG. 10 by grippers (not shown).

The leading edges of the reaches 162, 166 are beyond the leading edge of the slab 104 stationary on the platen 152. When the reaches are in the described positions, an envelope 168 is formed therefrom by means of a sealing device 170 which is mounted to reciprocate vertically in the direction indicated by the arrow L, being driven by an actuating means (not shown). The sealing device constitutes a plunger disposed horizontally above a slab at rest on the platen 152. The plunger has a plan configuration which is of the same shape as the slab but is slightly larger. The edges of the plunger have a depending flange which defines a shape of a rectangle larger than the plan configuration of the slab.

The lower edge of the depending flange is chamfered to a narrow dimension. The flange is heated and when the plunger is lowered into contact with the reaches 162, 166 on the platen around the slab a heat seal will be formed which autogeneously welds the reaches to one another around the periphery of the slab, resulting in creation of the envelope 168 that ensheathes the slab 104 on the platen 152. This envelope loosely embraces the slab, being somewhat oversize, for example, a few inches longer than the slab, a few inches wider than the slab and less than a few inches thicker than the slab. It is an ancillary feature of the invention that the envelope does not have to be nicely sized to snugly receive the bitumen slab but can conveniently be made somewhat oversized thus simplifying the formation of the envelope and rendering less critical the exact location of the slab on the platen prior to packaging thereof.

After the envelope has been formed the plunger 170 is raised leaving the wrapped slab on the platen.

Thereafter the bar 154 is actuated to move it against the trailing edge of the envelope and slab thereon and is further moved in the direction K to shift the enveloped slab onto a roller conveyor 172 in front of the wrapping station. The roller conveyor transports the wrapped slab away from the wrapping station in a direction indicated by the arrow M. The cionveyor 172 delivers loosely wrapped slabs, one after another, to the shrinking station 40 which is of conventional construction, constituting a shrink tunnel of any standard type. For example the shrink tunnel is a closed oven the opposite ends of which are blocked by curtains such as a group of adjacent, hanging, limp, flexible, imperforate strips that in static condition form essentially closed ends for the oven but through which an article such, for instance, as a wrapped slab can pass with ease. Inside the tunnel is a belt conveyor which accepts wrapped slabs delivered to it by the roller conveyor 172 and carries the slabs through the tunnel to deposit the slabs onto a roller conveyor 174. The oven has a source of heat which may be electric light bulbs or electrically heated coils or hot water coils the purpose of which is to raise the temperature of the ambient air in the oven to the shrink temperture of the films unwinding from the rolls 156 and 158 and which now constitute the envelope 168. When the envelope reaches this temperature, the stress in the films is relieved, permitting the films to contract toward and approach their prestressed condition, thus constricting the film around the slab by the familiar shrink process. As the film shrinks, the envelope will tightly embrace the slab wrapped thereby so as to assume a taut condition in which the envelope faithfully follows the three dimensional configuration of the slab.

As has been mentioned previously a typical thickness of the films is from 80 to 200 microns which in polyethylene constitutes a tough strong package that not only is weather-resistant but which will not be torn even when handled roughly and which will not burst unless subjected to unusual stress.

This film does not adhere to the bitumen slab so that if it is desired to free a slab from its envelope it merely is necessary to cut the envelope with a sharp implement and withdraw the slab through the opening thus formed.

Moreover, as mentioned previously, there is the further advantage that the slab packaged in a polyethylene envelope can be placed in a melting vat and, when the slab is heated to melt the same, the polyethylene will melt along with the bitumen, indeed before the bitumen, and will be assimilated in the molten bitumen with which it is compatible and throughout which it will freely disperse without mechanical mixing so that it is not even necessary to expend time and effort to strip off the polyethylene envelope from the slab before using the bitumen.

Figure 11:
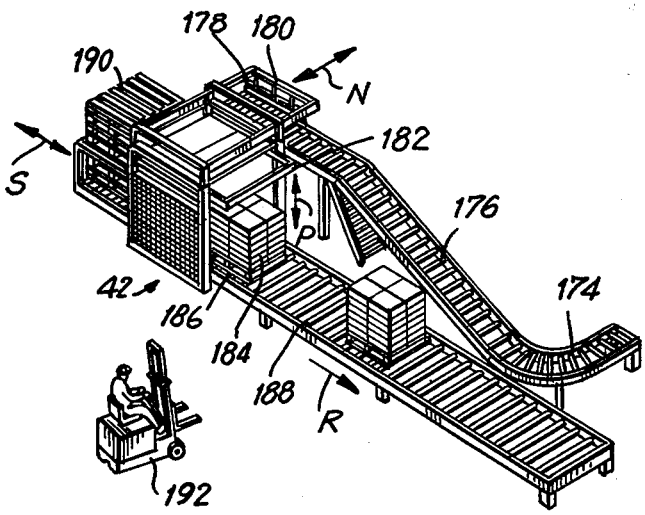
FIG. 11 is a perspective view of the palletizing station.

The conveyor 174 carries the slabs one after another to the palletizing station 42 (FIG. 11) where the slabs are lifted by an inclined power ramp 176 to a loading platform 178. A loading frame 180 has a portion thereof located over the loading platform 178. The loading frame is shiftable in a direction indicated by the arrow N. The loading frame reciprocates transversely every time that two packaged slabs come to rest on the platform 178, the first slab coming to rest against an abutment (not shown) and a following slab coming to rest against the first slab. The two slabs are transversely shifted to an elevator frame 182 which is movable in the direction indicated by the arrow P. The loading frame 180, when it shifts slabs off the loading platform, transports them to one side of the elevator frame which is the near side as seen in FIG. 11 and then is returned to the loading platform to await arrival of the next two slabs after which it shifts the next two slabs against the first two slabs on the elevator frame. At this time the elevator frame is in elevated rest position. The elevator frame is provided with movable detents that support two pairs of slabs (four in all) while the elevator frame is elevated and continues to support them until the frame is lowered to deposit the four packaged slabs on a stack 184. Successive double pairs of wrapped slabs thus are built up into a multitiered stack, as high as four meters, for example.

For ease of handling, the double pairs of slabs are lowered by the elevator frame onto a pallet 186 that is resting on a powered roller conveyor 188 that is intermittently driven to transport objects supported thereon in a direction indicated by an arrow R. Pallets 186 are slid from the bottom of a column 190 of pallets. Single pallets are delivered by a mechanism (not shown) in a direction indicated by the arrow S from the pallet column 190 to a proper location below the elevator frame 182. After a stack of desired height has been deposited on the pallet at the palletizing station, the roller conveyor 188 is energized to deliver the loaded pallet to a suitable position along the conveyor 188 where it is picked up and taken away to storage or to a delivery means by fork lift truck 192.

Thus it is seen that there are provided equipment and a process which achieve the various objects of the invention and which are well adapted to meet the conditions of practical use.

As various possible embodiments might be made of the above invention, and as various changes might be made in the embodiment thus set forth, it is to be understood that all matter here and described or shown in the accompanied drawings is to be interpreted as illustrative and not in a limiting sense.

Having thus described the invention, there is claimed as new and desired to be secured by Letters Patent:

1. A method of making and packaging slabs of bitumen and the like thermoplastic materials, comprising:

(A) providing a plurality of containers each constituting plural parts which are engageable and disengageable transversely with one another so that each container can be closed with an open mouth, closed sides and a closed bottom or open with an open mouth, open sides and an open bottom;

(B) manipulating successive open containers to close the same;

(C) heating the thermoplastic material to a molten state;

(D) successively filling the closed containers through their open mouths with metered amounts of molten material;

(E) cooling the filled closed containers to solidify the molten material in the containers into slabs;

(F) manipulating successive closed containers to open the side walls and bottoms thereof;

(G) successively discharging cooled slabs from the open containers;

(H) successively wrapping said cooled slabs in films of thermoplastic material; and (I) heat sealing the wrapped films to form closed envelopes around the cooled slabs;

(J) the thermoplastic material having a melting point lower than the melting point of the molten material and being compatible and dispersible in the material of the cooled slab when the latter is molten, whereby slabs and envelopes can be melted without removing the envelopes and without deleteriously affecting the characteristics of the bitumen-like material.

2. A method as set forth in claim 1 wherein the thermoplastic material is polyethylene.

3. A method as set forth in claim 1 wherein the films of thermoplastic material in which the cooled slabs are wrapped are biaxially oriented, stretched and heat-shrinkable, wherein the closed envelopes loosely contain the cooled slabs, and wherein the loose envelopes with the cooled slabs therein are heated sufficiently to shrink them tautly about the slabs so as to assume configurations that faithfully follow those of the slabs and thereby provide tough, strong weather-resistant packages.

4. A method as set forth in claim 3 wherein the thermoplastic material is polyethylene.

5. A method as set forth in claim 1 including the further step of stacking the slab-containing envelopes on pallets.

6. A method as set forth in claim 1 including the further step of pressing the cooled slabs down through the open mouths of the open containers so as to eject said slabs.

7. A method as set forth in claim 1 wherein the containers are provided with release coatings to facilitate discharge of the cooled slabs therefrom.

8. A method as set forth in claim 1 wherein the containers after discharge of said slabs are closed and refilled with metered amounts of molten material.

* * * * *